US006347837B1

(12) United States Patent
Watson et al.

(10) Patent No.: US 6,347,837 B1
(45) Date of Patent: Feb. 19, 2002

(54) SLIDE ASSEMBLY HAVING RETRACTABLE GAS-GENERATOR APPARATUS

(75) Inventors: John D. Watson, Evergreen, CO (US); Paul Krogh, Fremont, CA (US); David B. Carnegie-Smith, Lesmurdie (AU); Mihailo Gavrilovic, Denver, CO (US); Ockert R. Fourie, Lesmurdie (AU)

(73) Assignee: BeckTek Limited, Pinjarra (AU)

( * ) Notice: Subject to any disclaimer, the term of this patent is extended or adjusted under 35 U.S.C. 154(b) by 0 days.

(21) Appl. No.: 09/288,952

(22) Filed: Apr. 9, 1999

Related U.S. Application Data

(60) Provisional application No. 60/123,781, filed on Mar. 11, 1999.

(51) Int. Cl.[7] ..... E21C 41/16; E21C 45/06; F24D 3/04

(52) U.S. Cl. ..... 299/13; 102/333

(58) Field of Search ..... 299/13; 102/333

(56) References Cited

U.S. PATENT DOCUMENTS

| | | | | |
|---|---|---|---|---|
| 2,281,103 | A | 4/1942 | MacDonald | 102/4 |
| 2,725,821 | A | 12/1955 | Coleman | 102/22 |
| 3,055,648 | A | 9/1962 | Lawrence et al. | 262/12 |
| 3,313,234 | A | 4/1967 | Mohaupt | 102/20 |
| 3,623,771 | A | 11/1971 | Sosnowicz et al. | 299/12 |
| 3,721,471 | A | 3/1973 | Bergmann et al. | 299/55 |
| 3,960,082 | A | 6/1976 | Sloevsky et al. | 102/22 |
| 4,007,783 | A | 2/1977 | Amancharla et al. | 166/135 |
| 4,040,355 | A | 8/1977 | Hopler, Jr. | 102/22 |
| 4,099,784 | A | 7/1978 | Cooper | 299/10 |
| 4,140,188 | A | 2/1979 | Vann | 175/4.51 |
| 4,141,592 | A | 2/1979 | Lavon | 299/16 |
| 4,149,604 | A | 4/1979 | Lockwood et al. | 175/57 |
| 4,165,690 | A | 8/1979 | Abrahams | 102/22 |
| 4,195,885 | A | 4/1980 | Lavon | 299/1 |
| 4,204,715 | A | 5/1980 | Lavon | 299/16 |
| 4,208,966 | A | 6/1980 | Hart | 102/20 |
| 4,419,935 | A | 12/1983 | Shibukawa | 102/313 |
| 4,501,199 | A | 2/1985 | Mashimo et al. | 102/313 |
| 4,508,035 | A | 4/1985 | Mashimo et al. | 102/313 |
| 4,886,126 | A | 12/1989 | Yates, Jr. | 175/4.54 |
| 5,098,163 | A | 3/1992 | Young, III | 299/13 |
| 5,211,224 | A | 5/1993 | Bouldin | 166/63 |
| 5,308,149 | A | 5/1994 | Watson et al. | 299/13 |

(List continued on next page.)

FOREIGN PATENT DOCUMENTS

| | | |
|---|---|---|
| AU | 19834/24 | 9/1924 |
| AU | 71 742/74 | 7/1974 |
| AU | 8539461 | 3/1985 |

(List continued on next page.)

OTHER PUBLICATIONS

Don McCarthy; "Hydro–Fracturing Technology for Secondary Rock Breaking"; Eighth High–Tech Seminar, Nashville, TN; Jul. 20–24, 1998, pp. 47–60.

Atlas Copco; "We have found the hole"; Boltec Series product brochure; 8 pages.

Young, Chapman; Dick, Richard D.; Fourney, William L., "Small Charge Cone–Fracture Technique for Rapid Excavation", *Fragblast* '90, Aug. 26–31, 1990, Brisbane.

*Primary Examiner*—David Bagnell
*Assistant Examiner*—Jennifer H Gay
(74) *Attorney, Agent, or Firm*—Sheridan Ross P.C.

(57) ABSTRACT

The present invention is directed to a boom supporting a slide assembly. The slide assembly includes a guide track, a drill, and a stemming member for use in small charge blasting. The drill is initially moved along the guide track to form the drill hole. After the hole is completed, the drill is retracted along the guide track, and the stemming member is moved along the guide track and placed in the drill hole. After the stemming member fractures the rock, the stemming member is retracted along the guide track and the steps repeated to break new material. The stemming member has a breech and barrel that are located in the hole. The breech is either side- or front-discharging.

56 Claims, 14 Drawing Sheets

U.S. PATENT DOCUMENTS

| | | | | |
|---|---|---|---|---|
| 5,474,364 | A | 12/1995 | Ruzzi et al. | 299/13 |
| 5,564,499 | A | 10/1996 | Willis et al. | 166/299 |
| 5,611,605 | A | 3/1997 | McCarthy | 299/13 |
| 5,765,923 | A | 6/1998 | Watson et al. | 299/13 |
| 5,803,550 | A | 9/1998 | Watson et al. | 299/13 |
| 5,803,551 | A | 9/1998 | McCarthy | 299/13 |

FOREIGN PATENT DOCUMENTS

| | | | |
|---|---|---|---|
| AU | 73614/87 | | 5/1987 |
| AU | B-30436/92 | | 1/1995 |
| AU | 73576/96 | | 3/1997 |
| EP | 0 311 025 | | 5/1988 |
| FI | 80948 | | 4/1990 |
| GB | 800883 | | 9/1958 |
| RU | 2001268 | C1 | 11/1991 |
| SU | 968-393 | A | 4/1981 |
| WO | WO 91/02212 | | 2/1991 |
| WO | WO 92/02709 | | 2/1992 |
| WO | WO 95/28551 | | 10/1995 |
| WO | WO 97/06402 | | 2/1997 |
| WO | WO 97/10414 | | 3/1997 |
| WO | WO 98/20295 | | 5/1998 |
| ZA | 913432 | | 5/1991 |
| ZA | 952646 | | 3/1995 |
| ZA | 970578 | | 1/1997 |

SLIDE ASSEMBLY HAVING RETRACTABLE GAS-GENERATOR APPARATUS

RELATED APPLICATIONS

This application claims the benefits under 35 U.S.C. § 119(e) from U.S. Provisional Patent Application No. 60/123,781 entitled "SLIDE ASSEMBLY HAVING RETRACTABLE GAS GENERATOR APPARATUS" filed Mar. 11, 1999, which is incorporated herein by reference in its entirety.

FIELD OF THE INVENTION

The present invention is directed generally to devices for small charge blasting and specifically to devices for small charge blasting having a retractable gas generator.

BACKGROUND OF THE INVENTION

In mining and civil excavation work, small charge blasting or controlled fracture techniques are being introduced as alternatives to conventional drill-and-blast, mechanical breakers, chemical expansion agents and, in some cases, hand methods. "Small charge blasting" as used herein includes any excavation method where relatively small amounts of an energetic substance (typically a few kilograms or less) are consumed for each hole in a rock breaking sequence or where a pressurized fluid is sealed in the bottom of a drill hole by a stemming member to initiate and propagate a fracture in the material to be broken. "Sealing" refers to the partial or total blockage of the hole to impede escape of the fluid from the hole. Examples of small charge blasting devices and methods are described in U.S. Pat. Nos. 5,765,923; 5,308,149; and 5,098,163.

In many small charge blasting methods, a machine drills a hole into the rock to be broken and then inserts an elongated stemming member, which can be a stemming bar, a gas injector barrel, or other pressurizing device, into the hole. A pressurized working fluid, such as a liquid, gas, or another type of pressurizable fluid, is released rapidly into a portion of the hole, usually the bottom portion. The pressurized fluid is typically generated by combustion of a propellant or explosive source, by an electrical discharge into a conductive fluid, or by mechanical compression of the working fluid. The stemming member seals and stems the pressurized working fluid in the hole bottom and thereby causes fracturing of the rock. Small charge blasting can be highly mechanized and automated so that it can be carried out more or less continuously to increase productivity, can permit excavation machinery to remain near the face due to reduced fly rock discharge, and can have a seismic signature that is commonly relatively small because of the small amount of blasting agent used in the blasting sequence.

In designing a small charge blasting apparatus, there are a number of considerations. It would be desirable to use an inexpensive cartridge for providing the working fluid. By way of example, an all plastic cartridge housing could offer significant cost savings. It would also be desirable to have the drill and stemming member on a common boom to simplify the sequential alignment of the drill that forms the hole and the stemming member that is subsequently inserted into the hole. The boom is typically attached to undercarrier or other mounting mechanism. It would also be desirable to maintain an accurate and stable boom alignment relative to a point of reference on the excavation face for both the drilling process and the subsequent process of stemming member insertion. This is often difficult with an indexer mechanism (such as that shown in FIG. 8 of U.S. Pat. No. 5,098,163) which is front heavy and makes it difficult to maintain accurate alignment. Thus, the weight and moment arm of the boom should be substantially minimized not only to maintain an accurate and stable boom alignment but also to permit the use of lighter weight hydraulic systems and under carriers. Finally, the drill and stemming member should be positioned on the boom to permit the spent cartridge in the stemming member to be replaced with a new cartridge during drilling of the hole. If the drill and stemming member are located in close proximity to one another, mud and rock particles from drilling can enter the breech of the stemming member when the spent cartridge is in the process of being replaced with a new cartridge. This can lead to misfires or plugging or jamming of the breech and/or loading mechanism. Additionally, the mud and rock particles can plug the barrel of the stemming member and thereby cause damage to the stemming member when the pressurized working fluid expands down the barrel.

SUMMARY OF THE INVENTION

These and other objectives are realized by the various embodiments of the present invention.

In a first embodiment of the present invention, a small charge blasting device is provided that includes:

(a) a stemming member (e.g., a stemming bar, a gas-generator barrel, or other device for sealing the hole to pressurizing the working fluid in the hole) for insertion into the hole and (b) a slide assembly comprised of:

(i) a guide track and proximal and distal ends;

(ii) a drive mechanism (e.g., a belt drive, a chain drive, a worm gear drive, a pusher rod drive, a cable drive, a hydraulic or gas powered extending cylinder, or another suitable drive device) located adjacent to the guide track for moving the stemming member linearly back and forth along the track between the proximal and distal ends of the slide assembly (i.e., between its stowed and deployed (or working) positions); and (iii) a switching mechanism (e.g., a rotating or translating cradle mechanism, a lifting clamp mechanism, or a tracked switching mechanism) located adjacent to the drive mechanism at the proximal end of the slide assembly for transferring the stemming member from a stowed position at the proximal end of the slide assembly onto the guide track for transport to a deployed position at a distal end of the slide assembly. The ability of the stemming member to be retracted to the proximal end of the slide assembly for stowing lowers the weight and moment arm of the distal end of the boom supporting the slide assembly during positioning of the slide assembly by the boom and therefore permits the use of lighter weight (and less expensive) positioning hydraulics and simplifies alignment of the slide assembly with the hole. The lighter slide assembly weight also enables the slide assembly alignment to be maintained more accurately and with more stability since the large dynamic forces associated with a front-heavy indexer mechanism are substantially eliminated.

The small charge blasting device can include another tool for performing another type of unit operation such as a drill for forming a hole in a material to be broken. When stowed, the second tool is typically located on the proximal end of the slide assembly adjacent to the stowed stemming member and on an opposite side of the guide track from the stowed stemming member. The second tool and stemming member are alternatively and sequentially advanced by the drive mechanism along the guide track after being switched onto the guide track from their respective stowed positions to the excavation face to perform their separate functions. When the second tool is a drill that is located at the distal end of the slide assembly when it performs its drilling function, the stemming member will be in its stowed position at the proximal end of the slide assembly. Accordingly, the spent cartridge (from a previous shot) may be removed and a new cartridge inserted into or onto the stemming member during the drilling process without drilling water, mud and other debris entering the barrel, breech, or cartridge loading mechanism of the stemming member. The second tool and stemming member are thus located on a common boom and can be readily, simply and sequentially aligned with a desired location on the excavation face.

During operation, the drill (or other type of tool) and stemming member may be alternately and sequentially engaged with or disengaged from the drive mechanism and/or guide track by the switching mechanism. Because the dynamic forces are relatively low, the drill typically remains engaged with the drive mechanism during the drilling process. In contrast, because of the relatively large dynamic forces, the stemming member is typically disengaged from the drive mechanism during formation of the controlled fracture in the material. The significant recoil forces exerted on the stemming member resulting from fracture initiation and propagation can damage the drive mechanism.

The slide assembly can include one or more features to dampen recoil of the stemming member in response to the generation and/or release of the pressurized working fluid into the hole. For example, the guide track can include a clamping device (e.g., which is operated hydraulically, electrically, magnetically, or mechanically) for clamping the stemming member in the guide track to dissipate recoil energy of the stemming member after release of the working fluid into the hole. By way of illustration, the clamping device can be configured such that it clamps down on the plate on which the stemming member is rigidly attached. The guide track can also include a braking material having a static coefficient of friction of at least about 0.2 and more preferably ranging from about 0.5 to about 1.0 and a sliding coefficient of friction of at least about 0.2, more preferably ranging from about 0.2 to about 1.0, and even more preferably from about 0.2 to about 0.5 to dissipate the recoil energy of the stemming member as the stemming member recoils and moves along the guide track. In this manner, the guide track acts as a long brake pad to dissipate the recoil energy. The static force with which the stemming member would be held in the drill hole in the firing position would be dictated by the contact area between the plate attached to the stemming member and the guide track and the static coefficient of friction. The static force typically ranges from about 3,000 to about 25,000 lbs. Likewise, the retarding or breaking force resisting the recoil after firing would be dictated by the contact area between the plate and the guide track and by the sliding coefficient of friction. The retarding or braking force typically ranges from about 1,000 to about 25,000 lbs. If the recoil motion of the stemming member is terminated along the guide track, the clamping device would be disengaged and the drive mechanism re-engaged to move the stemming member to the proximal end of the guide track. Finally, either the slide assembly or the plate on which the stemming member is rigidly attached can be engaged with a shock absorbing device positioned behind the stemming member to dissipate either the full recoil energy should the clamping device fail or not be available; or any residual recoil energy not dissipated by the clamping device.

In a second embodiment of the present invention, a small charge blasting method is provided that broadly includes the following steps:

(a) engaging the stemming member with at least one of the drive mechanism and the guide track;

(b) advancing the stemming member linearly along the guide track on the slide assembly (e.g., from the stowed position to the deployed position) to insert the stemming member into the hole in the material to be broken;

(c) when the stemming member is positioned in the hole, pressurizing the working fluid in the hole to fracture the material to be broken;

(d) thereafter retracting linearly the stemming member along the guide to the stowed stemming member position; and (e) disengaging the stemming member from the at least one of the drive mechanism and guide track.

When the device includes a drill or another type of tool mounted on the slide assembly with the stemming member, the method further includes the following steps either before the engaging step (a) or after the disengaging step (e):

(f) engaging the drill with at least one of the drive mechanism and guide track;

(g) advancing the drill (or other tool) linearly along the guide track (e.g., from the stowed position to the deployed position) to form the hole;

(h) retracting the drill linearly along the guide track, after hole formation, to the stowed position; and (i) disengaging the drill from the at least one of the drive mechanism and guide track. These steps are repeated, blasting sequence by blasting sequence, to break the material.

In a specific application of the method broadly set forth above, the following specific steps are performed:

(a) switching the drill onto the guide track from the stowed drill position;

(b) engaging the drill with the drive mechanism;

(c) advancing the drill (or other tool) linearly along the guide track to the deployed drill position;

(d) forming the hole;

(e) retracting the drill (or other tool) linearly along the guide track;

(f) disengaging the drill (or other tool) from the guide track and the drive mechanism;

(g) switching the drill (or other tool) to the stowed drill position;

(h) switching the stemming member from the stowed position onto the guide track from the stowed stemming member position;

(i) engaging the stemming member with the drive mechanism;

(j) advancing the stemming member linearly along the guide track to the deployed stemming member position (e.g.,to insert the stemming member into the hole):

(k) disengaging the drive mechanism from the stemming member;

(l) optionally clamping the stemming member to the slide assembly;

(m) when the stemming member is inserted into the hole, pressurizing the working fluid in the hole to fracture the material to be broken;

(n) unclamping the stemming member from the slide assembly;

(o) reengaging the stemming member with the drive mechanism;

(p) retracting the stemming member linearly along the guide track;

(q) disengaging the stemming member from the guide track and the drive mechanism; and (r) switching the stemming member to the stowed stemming member position. During one or more of steps (a) to (g), the spent cartridge in the stemming member from a previous shot may be replaced with a new cartridge. These steps are repeated hole-by-hole to remove the desired material.

In a third embodiment of the present invention, the stemming member includes the following specific components:

(a) a breech for receiving a cartridge, the cartridge containing an energetic substance for generating a pressurized working fluid;

(b) a cartridge ejector mechanism (e.g., a manual or hydraulically actuated push or ejector rod, a pneumatic ejection system, a mechanism that grabs and pulls the cartridge forward, or any other extraction mechanism common in ordinance technology) that expels the (spent) cartridge through a front portion of the breech after generation of the pressurized working fluid; and (c) a barrel to be received in a hole in a material to be broken. The barrel is in communication with the front portion of the breech to release the pressurized working fluid into the bottom of the hole. The barrel and breech are preferably both located in the hole.

The cartridge may be inserted into the breech in any desirable manner. For example, the cartridge may be inserted into the breech through the back end of the breech (the breech being a so-called mobile breech mechanism), and chambered in a combustion chamber. Alternately, the cartridge may be inserted through the front or side of the breech directly into the combustion chamber (the breech being a so-called permanent or immobile breech).

In one configuration of the stemming member in the third embodiment, the spent cartridge is ejected through the front or distal end of the device by a push rod otherwise called an ejector rod. The cartridge is preferably inserted into the breech by being pushed into place and thereafter ejected (after use) by being pushed out of the breech and out of the downhole end of the barrel. This configuration eliminates the need for the cartridge to be pulled by the ejector mechanism, which typically requires a cartridge extractor mechanism and extractor grooves in the cartridge. By pushing the cartridge for insertion and ejection, the rear of the cartridge can be formed such that there are no grooves, voids or spaces in the rear of the cartridge. In other words upon chambering the cartridge in the combustion chamber, the rear of the cartridge is in intimate contact with the face of the breech and the walls of the combustion chamber. The absence of voids or spaces removes the requirement for the base of the cartridge base to have enough mechanical strength to resist collapse of the base material into any voids or spaces during the combustion process. Thus the cartridge housing can be formed from relatively low-strength and inexpensive materials such as plastics (e.g., polyethylene, polypropylene, nylon, or co-polymer combinations of these). Alternately, the cartridge housing can be formed from a combustible material (e.g., typically comprised of nitrocellulose, cellulose, wood pulp and resins) so that the cartridge housing is entirely consumed in the combustion and there is no cartridge housing to eject. Alternately, the cartridge can be formed from the energetic substance alone and have no outer housing such as a cartridge formed by a foamed explosive or propellant combination.

In another configuration of the stemming member in the third embodiment, the combustion chamber is located at the distal end of the device so that when the device is inserted to the bottom of the drill hole, the front end of the cartridge is in close proximity to and substantially in communication with the bottom of the hole. The pressure developed in the bottom of the hole is substantially the same as the pressure developed in the combustion chamber.

The outside diameter of the distal (i.e., downhole) end of the stemming member can be slightly less than the diameter of the drill hole to form a sealing band. The pressurized fluid in the hole bottom is substantially impeded from leaking via the sealing gap between the sealing band portion of the barrel and the wall of the hole. Alternately and preferably, the outside diameter of the distal (i.e., downhole) end of the stemming member is significantly smaller than the hole diameter and the sealing band (which is located between the distal end of the stemming member and the hole opening) for a length along the barrel equal to at least about 50% of the diameter of the hole bottom. The sidewall of the hole adjacent to the distal end of the stemming member is pressurized to the same level as the hole bottom which promotes conditions for more efficient penetrating cone fracture formation and propagation.

To provide a relief volume for the controlled expansion of the working fluid and/or to permit the cartridge to be extracted, the downhole end of the bore in the barrel expands (e.g. is tapered) outwardly. In this manner, the pressurized fluid expands into the relief volume in the bore prior to release into the hole.

DETAILED DESCRIPTION

Figure 1:
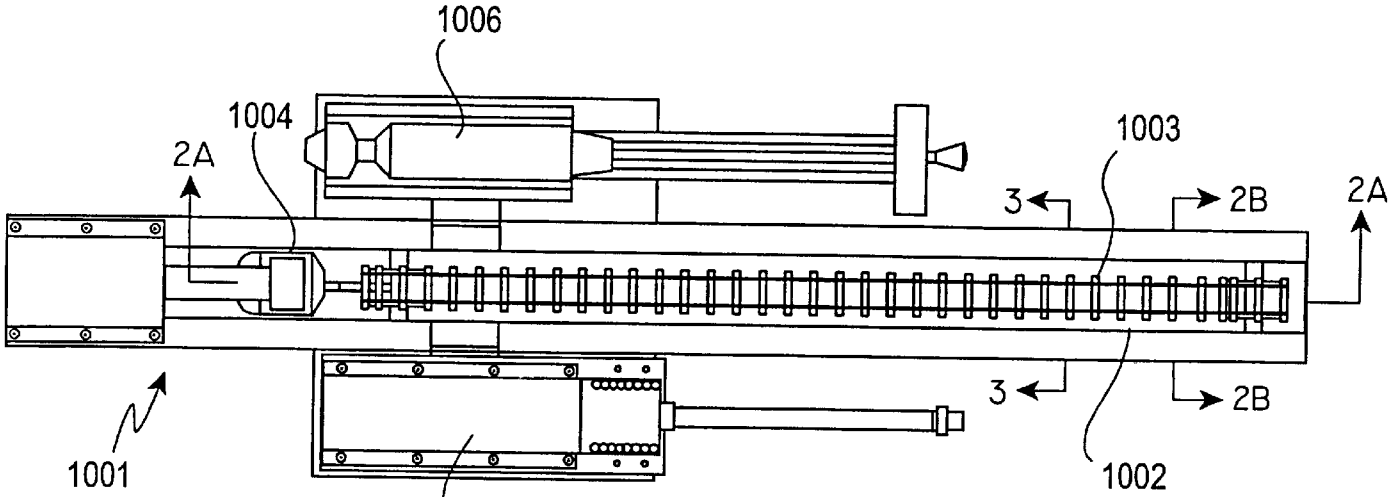
FIG. 1 is a plan view of a slide assembly showing a guide track, a drive mechanism, a stemming device in stowed position, and a drill in stowed position.
Figure 2B:
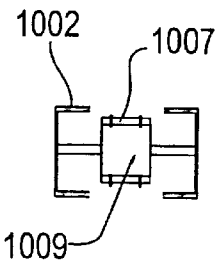
FIG. 2B is an end view of the slide assembly taken along line 2B—2B of FIG. 1.
Figure 2A:
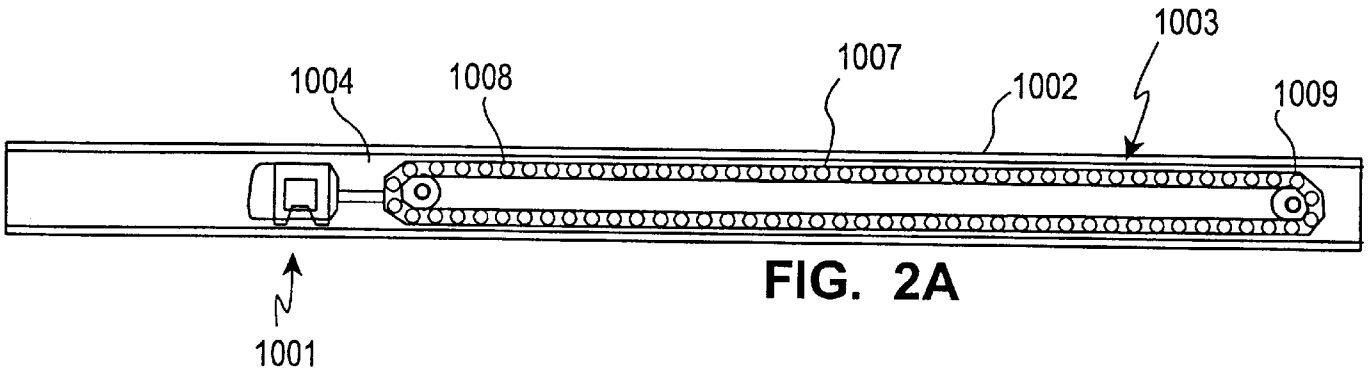
FIG. 2A shows a cutaway side view taken along lines 2A—2A of FIG. 1
Figure 3:
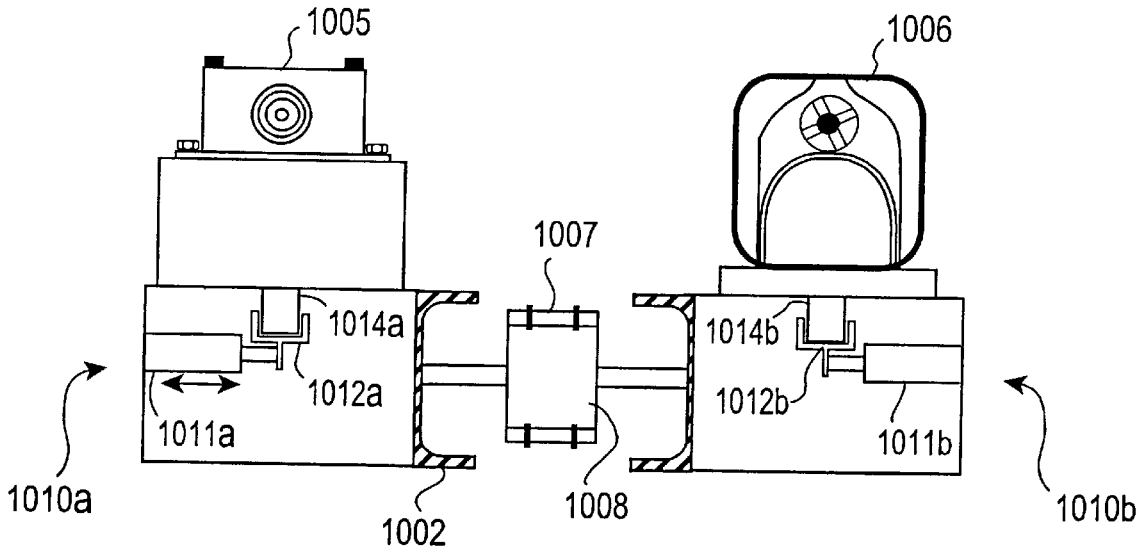
FIG. 3 is a cutaway cross-sectional view of the slide assembly taken along line 3—3 of FIG. 1 showing the switching mechanism.

FIGS. 1–3 show various views of a slide assembly 1001 which is comprised of a guide track 1002 extending substantially the length of the slide assembly, a chain drive mechanism 1003 (also extending substantially the length of the guide track 1002) and powered by a motor 1004 (such as by an electric or hydraulic drive motor), and a switching mechanism 1010*a* and *b*located at the proximal end of the slide assembly and on opposing sides of the guide track. The guide track and chain drive mechanism have longitudinal axes that are parallel to one another and to the longitudinal axis of the slide assembly. A stemming member (e.g., a gas-generator device) 1005 and a drill 1006 are shown in their stowed positions on opposing sides of the guide track. The slide assembly is typically mounted on a boom (not shown) of a machine (not shown) which manipulates and controls the position of the slide assembly relative to the excavation face.

FIGS. 2A and 2B are respectively a cutaway side view and a cross-sectional view of the slide assembly 1001 showing the guide track 1002, the chain drive mechanism 1003 and the drive motor 1004. The chain drive mechanism has a continuous chain 1007 mounted on opposing sprockets 1008 and 1009 mounted on opposing ends of the slide assembly. The guide track and chain are located along the longitudinal central axis of the slide assembly.

FIG. 3 shows a cutaway cross-sectional view of the slide assembly 1001 taken through a typical switching mechanism 1010*a* and *b* for switching one of either the drill 1006 or stemming member 1005 onto the drive mechanism 1003. The switching mechanism 1010*a* and *b* includes a lateral displacement cylinder 1011*a* and *b* engaging a bracket 1012*a* and *b* which in turn releasably engages an engaging mechanism 1014*a* and *b* extending downwardly from each of the stemming member 1005 or drill 1006. The displacement cylinder 1011*a* and *b* moves laterally back and forth to switch and unswitch the generator or drill to and from the drive mechanism. When one of the tools 1005 or 1006 is switched onto the drive mechanism 1003, the bracket is disengaged from the engaging mechanism and the tool is thereafter attached by the engaging mechanism 1014*a* and *b* to the drive mechanism 1003 so that it can be moved along the slide assembly. The engaging mechanism engages the chain between adjacent and opposing chain links.

Figure 4:
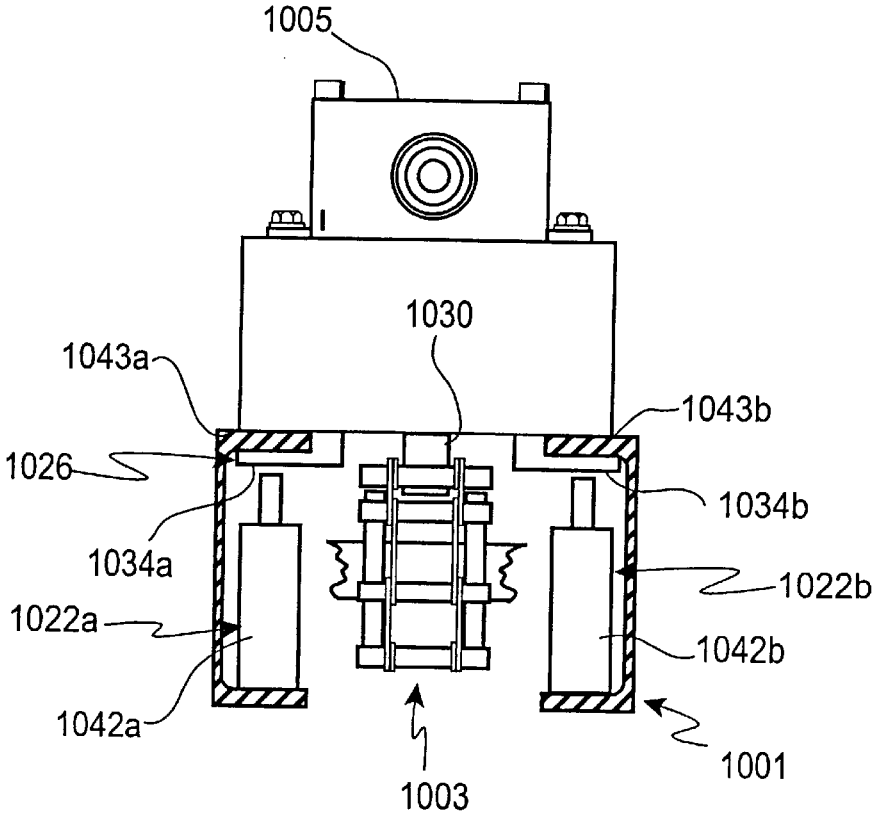
FIG. 4 is a cutaway cross-sectional view taken along line 4—4 of FIG. 7F of a clamping mechanism that provides a recoil braking function for the stemming member.

FIG. 4 (which shows the stemming member engaged with the drive mechanism) illustrates a clamping mechanism 1022*a* and *b* that provides a recoil braking function for the stemming member 1005 after generation of the working fluid. This cross-sectional view also shows the slide assembly 1001 and the drive mechanism 1003. The clamping mechanism includes mounting plate 1026 (which includes opposing guide plates 1034*a* and *b*) and clamping cylinders 1042*a* and *b*. Each of the guide plates includes a braking surface 1043*a* and *b* to dissipate recoil energy as thermal energy. A stemming member 1005 is shown attached to the mounting plate 1026 which is attached by an engaging mechanism 1030 to the drive mechanism 1003. The mounting plate 1026 is constrained by the guide plates 1034*a* and *b* so that it can only move along the guide track 1002 (during which time the clamping cylinders 1042*a* and *b* are each in the disengaged (retracted) position). When the stemming member 1005 is moved forward into firing position, it is propelled freely between the guide plates 1034 *a* and *b* by the drive mechanism 1003. When the generator device 1005 has been moved into firing position, its engaging mechanism 1030 is released from the drive mechanism 1003. After this operation, the clamping cylinders 1042 *a* and *b* are projected upward, forcing the guide plates to clamp onto the inner walls of the guide track to function as holding means to maintain the stemming member 1005 in its firing position). The braking surfaces 1043*a* and *b* function as a holding means by virtue of its static coefficient of friction which is at least about 0.5, more preferably ranging from about 0.5 to 0.75, and even more preferably ranging from about 0.5 to 1.0.

When the energetic substance is fired by the stemming member 1005, the stemming member impulsively accelerates back, recoiling along the slide assembly 1001. The recoil accelerating force overwhelms the static holding force of the braking surfaces and the braking surfaces now function as a brake pad. The braking clamp mechanism 1022*a* and *b* begins to decelerate the recoiling mass and is designed to stop it before it reaches the end of the guide track where the tools are stowed. The braking surfaces 1034*a* and *b* each have a sliding coefficient of friction of at least about 0.2, more preferably ranging from 0.2 to 1.0, and even more preferably ranging from about 0.2 to 0.5 which, when combined with the surface area of the braking surfaces bearing on the adjacent inner surfaces of the sides of the guide track, collectively entirely or substantially dissipate the recoil energy primarily by mechanical friction.

Figure 5:
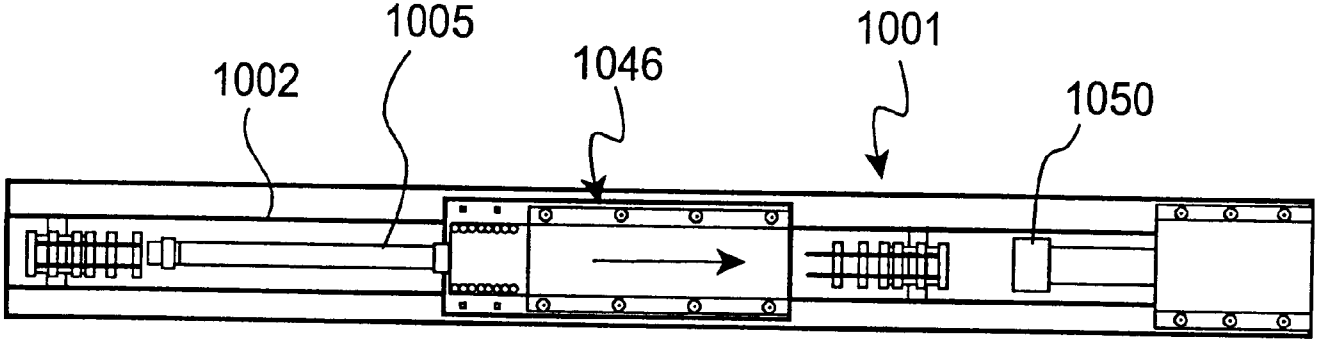
FIG. 5 is a plan view of a recoiling stemming member and a shock absorber that can provide full or partial recoil dissipation.

FIG. 5 shows a plan view of a stemming member 1005 recoiling along the guide track 1002. The braking clamp mechanism described in FIG. 4 is slowing the recoiling mass 1046 as the recoiling mass moves from the distal end back towards the proximal end of the guide track 1002 where the tools are stowed. The recoiling mass 1046 is comprised of all the hardware attached to the mounting plate 1026, including the stemming member 1005. A recoil shock absorber 1050 is mounted at the end of the guide track 1002. The recoil shock absorber 1050 can be designed to provide full or partial recoil dissipation. If the braking clamp mechanism fails to fully stop the recoiling mass 1046, then the recoil shock absorber 1050 will complete the braking process.

Figure 6:
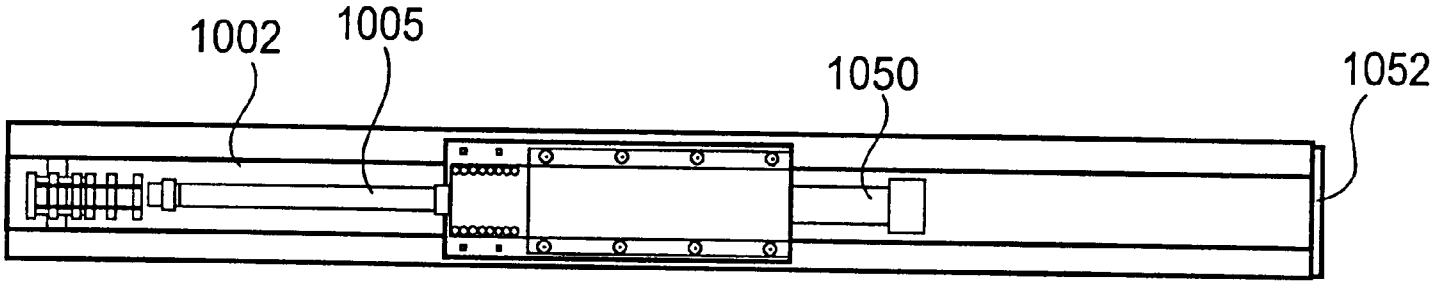
FIG. 6 is a plan view of an alternate configuration for attaching the recoil shock absorber.
Figure 7A:
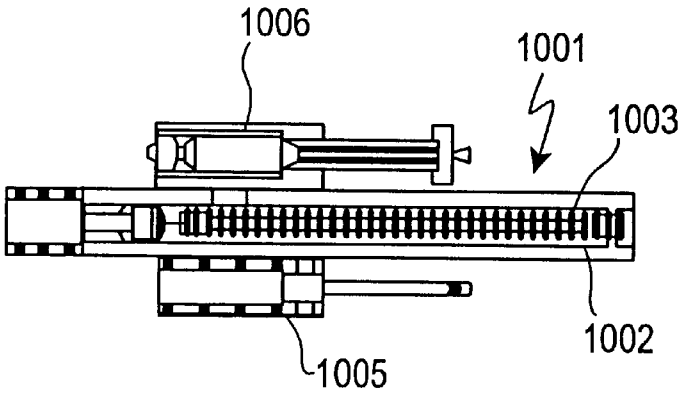
FIGS. 7A–K show an illustrative sequence in plan view of the various operations of the apparatus for drilling and shooting.
Figure 7B:
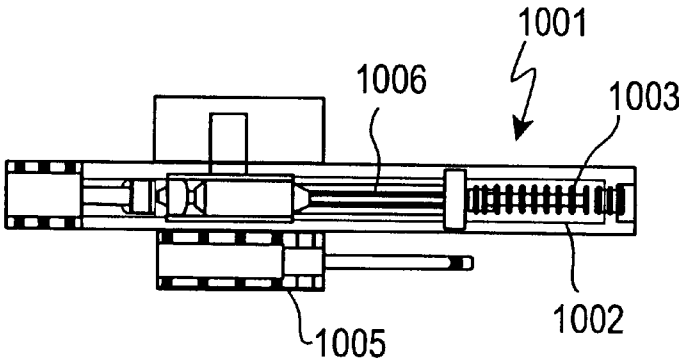
Figure 7C:
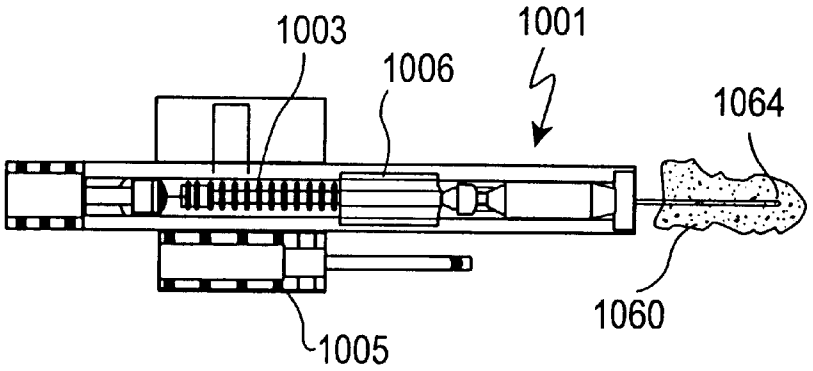
Figure 7D:
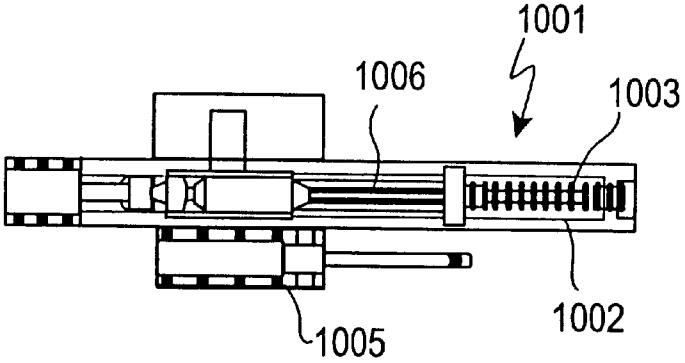
Figure 7F:
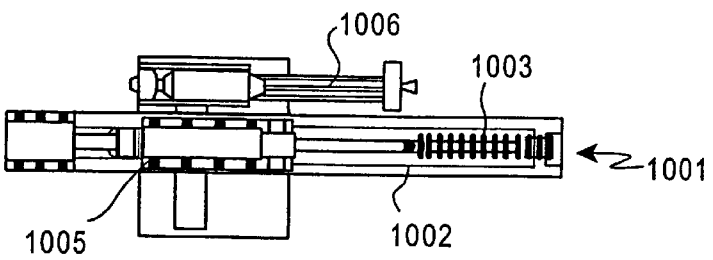
Figure 7E:
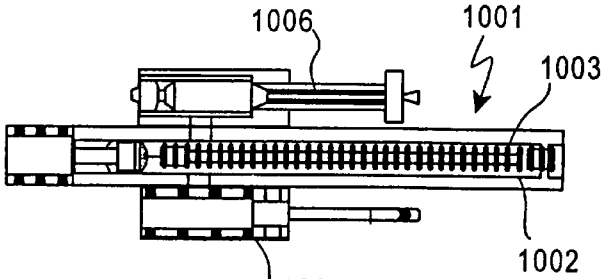
Figure 7G:
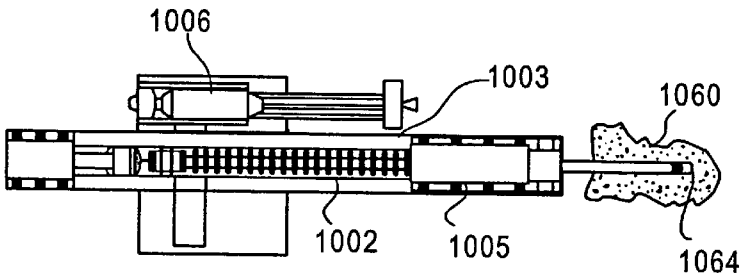
Figure 7I:
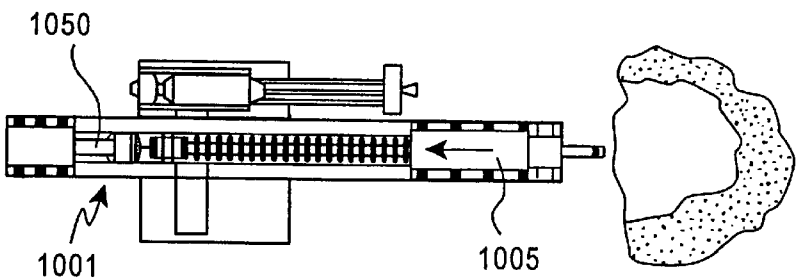
Figure 7H:
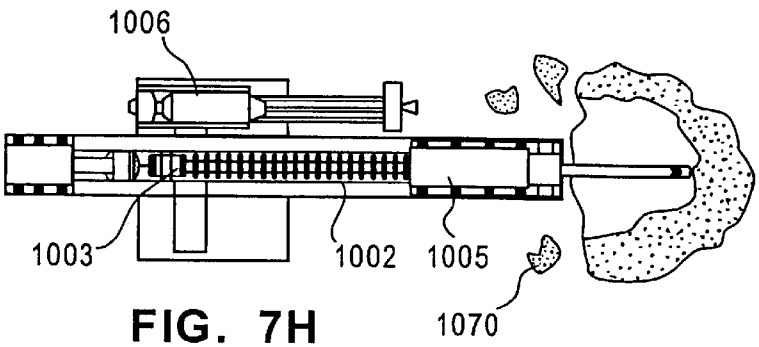
Figure 7J:
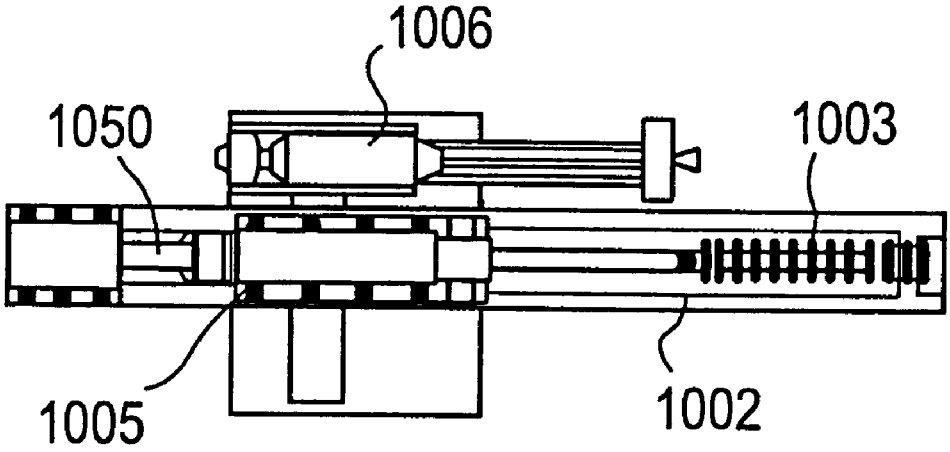
Figure 7K:
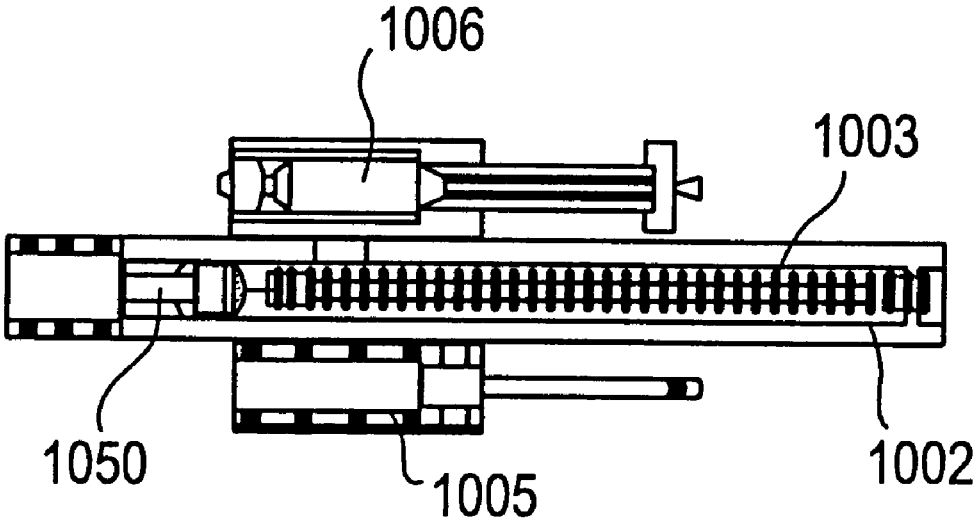

FIG. 6 shows a plan view of an alternate configuration for attaching the recoil shock absorber 1050. In this configuration, the recoil shock absorber 1050 is attached on the rear of the recoiling mass 1046 and contacts a vertical plate 1052 on the proximal end of the slide assembly 1001 to stop the recoiling mass 1046. The recoil shock absorber 1050 can be designed to provide full or partial recoil dissipation. If the braking clamp mechanism, described in FIG. 4, fails to fully stop the recoiling mass 1046, then the recoil shock absorber 1050 will complete the braking process.

FIGS. 7A–K collectively show an illustrative sequence in plan view of the various operations of the apparatus for drilling and shooting. In step (a) (FIG. 7A), the stemming member 1005 and a rock drill 1006 are shown in their stowed positions at the proximal end of the slide assembly 1001. The stemming member 1005 has an unfired cartridge or other means for its gas-generating function. In step (b) (FIG. 7B), the drill 1006 is shown switched onto the guide track and engaged to the drive mechanism 1003 at the proximal end of the slide assembly 1001. In step (c) (FIG. 7C), the drill 1006 has been moved linearly forward by the drive mechanism 1003 along the guide track into position at the rock face 1060 at the distal end of the slide assembly and is shown drilling a hole 1064 in the rock. In step (d) (FIG. 7D), after completion of the hole, the rock drill 1006 has been returned to the proximal end of the slide assembly 1001 by the drive mechanism 1003 along the guide track. In step (e) (FIG. 7E), the drill 1006 has been disengaged from the drive mechanism 1003 and switched from the guide track into stowed position at the proximal end. In step (f) (FIG. 7F), the gas-generator device 1005 is shown switched onto the guide track and engaged with the drive mechanism 1003. In step (g) (FIG. 7G), the stemming member 1005 has been moved from the proximal end of the slide assembly linearly forward by the drive mechanism 1003 to the distal end of the slide assembly and into the drill hole 1064 in the excavation face 1060. The stemming member 1005 has been disengaged from the drive mechanism 1003 and the brake clamping mechanism (not shown) has been activated to secure the stemming member 1005 in firing position. In step (h) (FIG. 7H), the stemming member 1005 has been fired; has broken out an amount of rock 1070; and has achieved its full recoil velocity though the device 1005 has not recoiled back more than several millimeters. In step (i) (FIG. 7I), the stemming member 1005 is shown recoiling back towards the proximal end of the slide assembly 1001 and is ultimately brought to rest by the braking clamp mechanism (not shown) and/or the recoil shock absorber 1050. The stemming member 1005 will come to rest somewhere along the slide assembly 1001 and will be re-engaged to the drive mechanism 1003. In step (j) (FIG. 7J), the stemming member 1005 is positioned by the drive mechanism 1003 beside its switching mechanism 1005 at the proximal end of the slide assembly 1001. In step (k) (FIG. K), the stemming member 1005 is disengaged from the drive mechanism and switched from the guide track to the device's stowed position where the expended cartridge is ejected and a new cartridge is inserted such as by an autoloader (not shown) positioned at the proximal end adjacent to and on the same side of the guide track as the generator device. This sequence of steps is repeated to continue excavating the rock.

Figure 8:
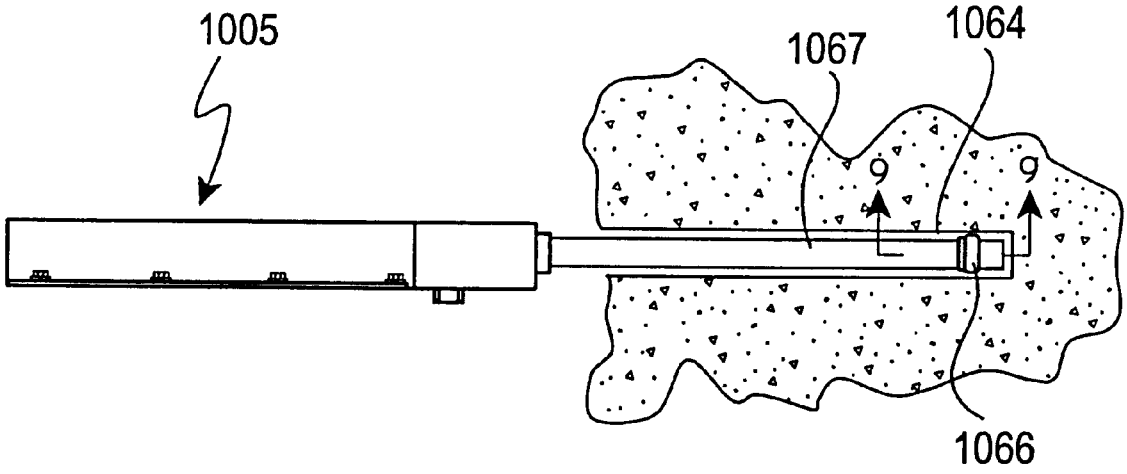
FIG. 8 shows a plan view of a typical stemming member in firing position in the drill hole.

Referring to the details of the stemming member 1005, FIG. 8 shows a plan view of a typical stemming member 1005 in firing position in the drill hole 1064. The stemming member 1005 typically pressurizes the bottom portion of the drill hole 1064 by forming a seal with the sidewalls of the hole at or near the hole bottom (i.e., adjacent the sealing band 1066 portion of the barrel 1067).

Figure 9:
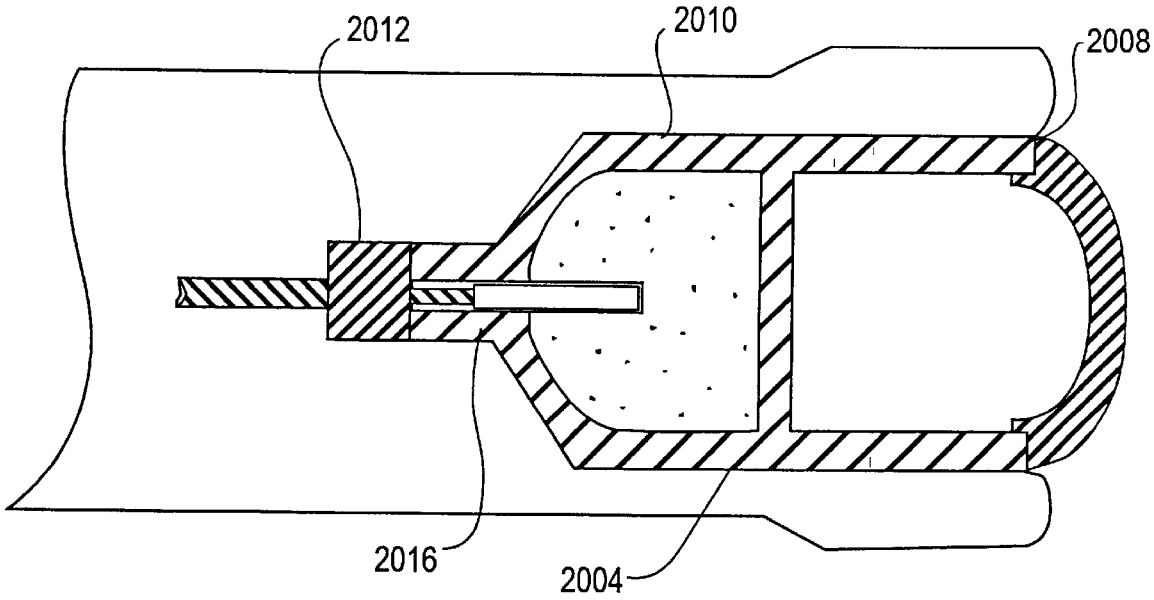
FIG. 9 is a cross-sectional side view taken along line 9—9 of FIG. 8 of a combustion chamber/breech of the stemming member for a cartridge inserted and ejected from the front end.

FIG. 9 shows a cutaway side view of the distal (i.e. downhole) end of the stemming member 1005 in which a cartridge 2004 is inserted into and ejected from the front end or muzzle 2008 of the device 1005. The cartridge 2004 is usually inserted at the rear or front end of the slide assembly described in FIG. 1 when the stemming member 1005 is in its stowed position at the proximal end of the slide assembly. The cartridge may be inserted by hand or by the autoloader mechanism. The spent cartridge is ejected forwardly out the front end or muzzle 2008 by an ejector rod 2012 when the stemming member 1005 is in stowed position at the proximal end of the slide assembly described in FIG. 1. The ejector rod extends substantially the length of the stemming member, is coaxial with the longitudinal central axis of the stemming member, and is able to extend to a position at or near the muzzle 2008 to push the cartridge forwardly out of the discharge opening of the muzzle. To facilitate ejection, the interior walls 2010 of the muzzle 2008 are tapered outwardly (and the walls of the cartridge are also tapered outwardly to mirror the shape of the interior walls 2010). The cartridge 2004 may be initiated in any number of ways by means located in the ejector rod 2012 and communicating with the base 2016 of the cartridge. Initiation may be by contact electrical, inductive electrical, thermal, optical such as by a laser, or any other suitable technique.

Figure 10:
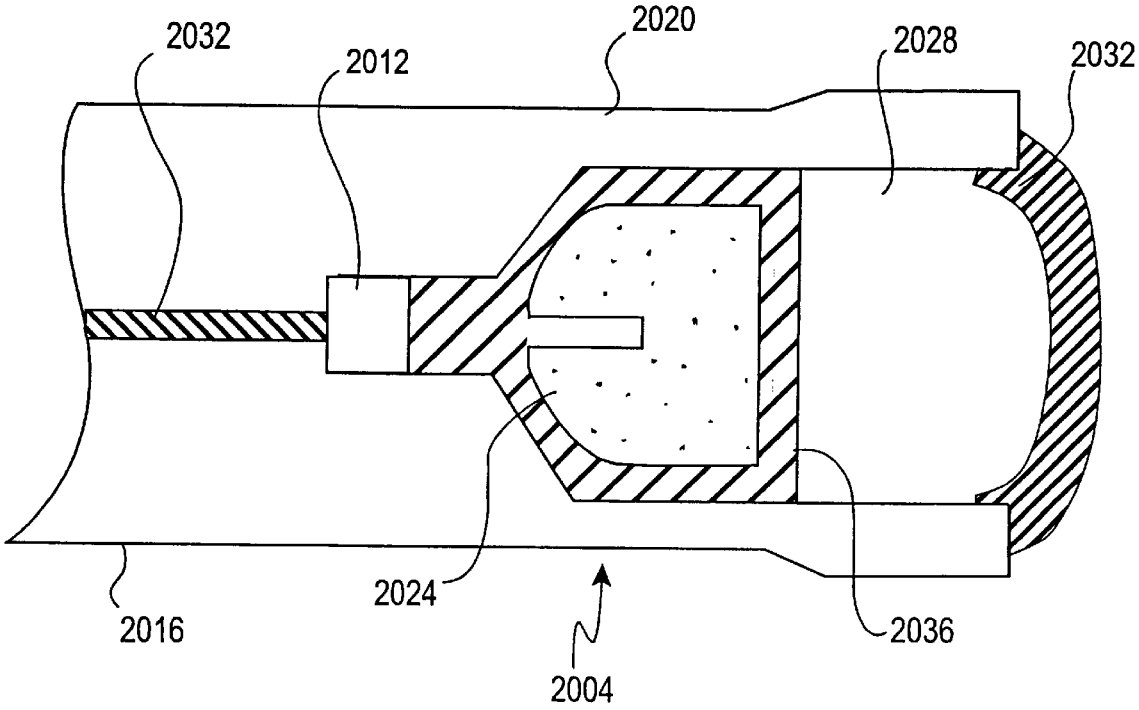
FIG. 10 is a cross-sectional side view of the cartridge with an end cap that can be inserted and ejected from the front end of the stemming member.

FIG. 10 is an enlarged, cutaway, side view of the cartridge 2004 of FIG. 9 that would be inserted and ejected from the front end or muzzle of a stemming member such as that shown in FIG. 9. The cartridge 2004 is typically comprised of a plastic body 2020, an energetic substance 2024 such as a propellant, a relief volume 2028 (that is substantially free of the energetic substance and is typically an empty space), a cap 2032 for keeping extraneous water or mud from the hole bottom from entering the relief volume 2028. The cartridge 2004 also includes an energetic substance initiating means 2032. The cartridge 2004 may include a partition 2036 for separating the energetic substance 2024 from the relief volume 2028 so as to more efficiently initiate the energetic substance 2024.

The cartridge can be of any suitable design. Preferably, the total internal volume of the cartridge available to combusted gas products is such that the average density of the fully combusted gaseous products ranges from about 100 to about 800 kg/cubic meter. This range of mass densities ensures that the average pressure developed by combusting the energetic substance is in a range suitable for effective rock breaking by controlled fracture methods such as penetrating cone fracture. This range of uncombusted energetic substance densities can be achieved not only by separating the bulk energetic substance from an internal relief volume but also by co-mingling the energetic substance with the internal relief volume.

Figure 11:
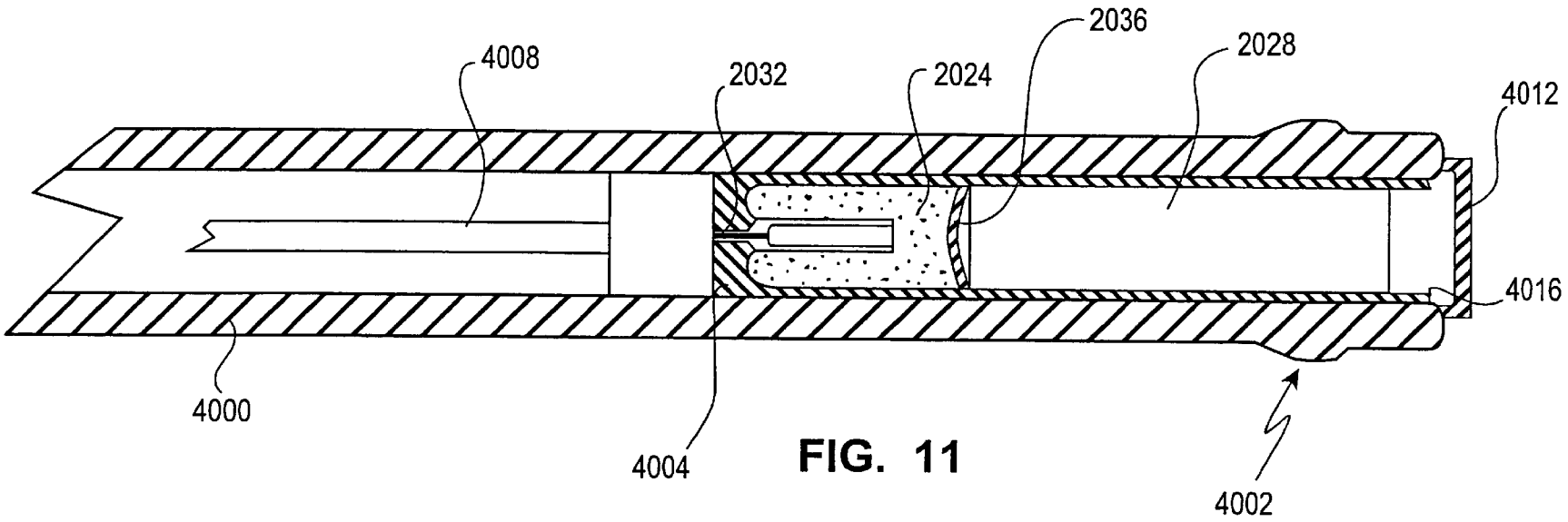
FIG. 11 is a cross-sectional side view taken along line 9—9 of FIG. 8 of another configuration of a combustion chamber/breech for a cartridge inserted from the back end of the stemming member and ejected from the front end of the stemming member.

FIG. 11 shows a cutaway side view of the distal (downhole) end 4002 of another configuration of a stemming member 4000 in which a cartridge 4004 is inserted from the proximal end of the stemming member 4000 by a push rod 4008 until it is positioned for firing with the front end cap 4012 aligned with or just protruding from the front end or muzzle 4016. After the cartridge 4004 has been fired, the push rod 4008 ejects the cartridge 4004 through the distal end or muzzle 4016.

Figure 12A:
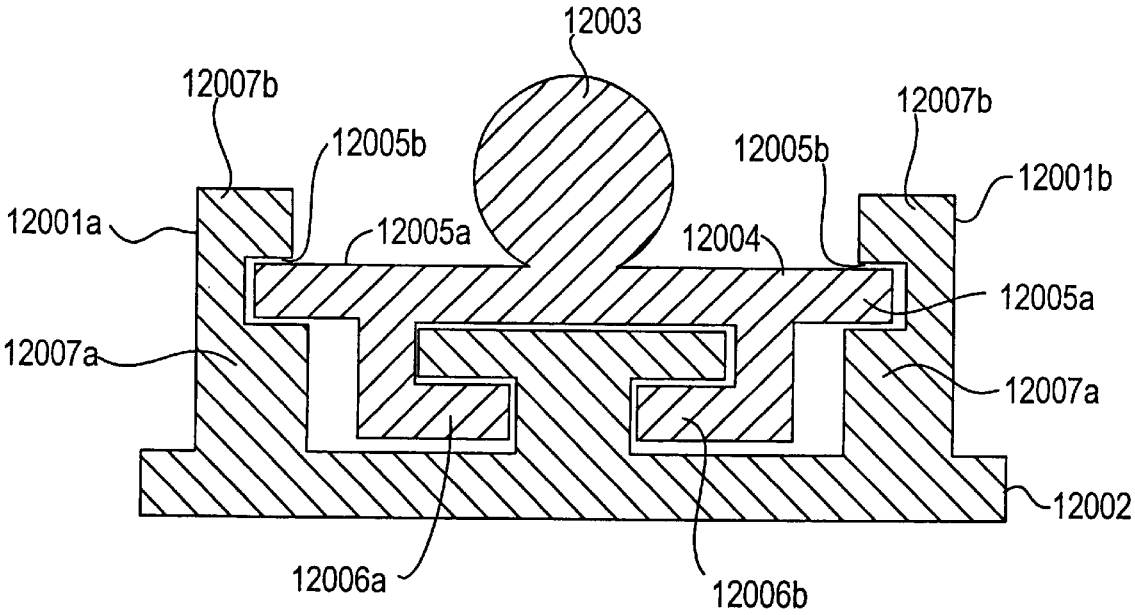
FIGS. 12A and 12B are respectively a cross-sectional view taken along line 12A—12A of FIG. 12B and a plan view of an alternate embodiment of a brake system for dissipating recoil energy of the stemming member in which the brake clamp assembly is attached to the feed assembly base and the brake pad is attached to the recoiling mass.
Figure 12B:
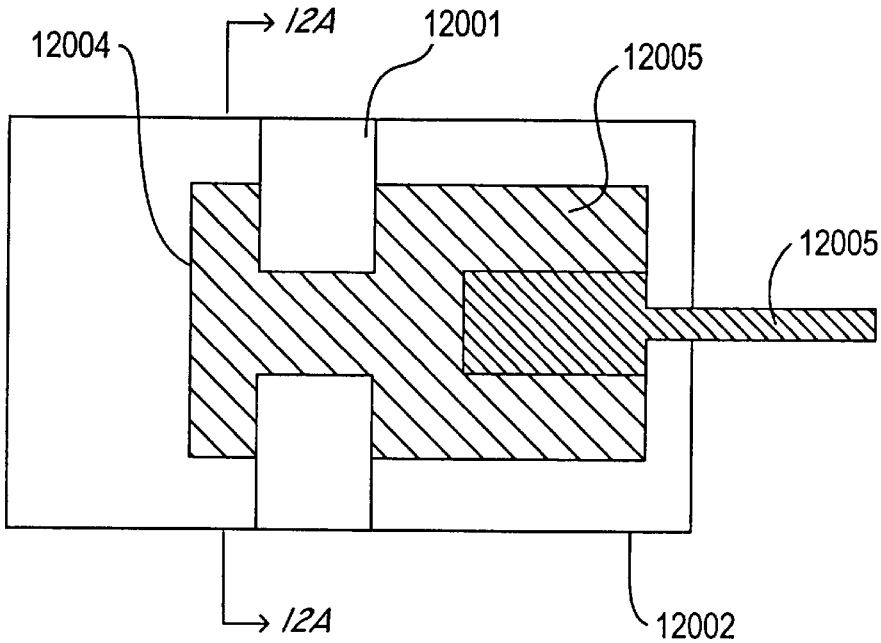

FIGS. 12A and B show an alternate embodiment for a brake clamping mechanism 12001 for dissipating recoil of a gas-generating device. The clamping mechanism 12001 is incorporated into the slide assembly 12002 and is not part of the recoiling mass. The stemming member 12003 is attached solidly to a mounting plate 12004 which is constrained to move axially along the slide assembly 12002 by the inwardly facing guide plates 12006*a* and *b*. Each of the guide plates 12006*a* and *b* has opposing braking surfaces 12005*a* and *b* which extend substantially the length of the mounting plate. As noted above, the opposing upper and lower jaws 12007*a* and *b* of each of the clamping mechanisms 12001*a* and *b* move towards and away from one another to clamp and unclamp the mounting plate 12004 between them. Referring to FIG. 12B, the hatched components, comprised of the gas-generating device 12005, the brake clamping mechanisms, and the mounting plate 12004, move linearly forwards and backwards along the slide assembly 12002. In this embodiment, the mounting plate 12004 is relatively massive and increases the mass of the recoiling components which may be advantageous in many circumstances. As will be appreciated, the braking surface can be formed by a braking material located only on the braking surfaces or on both the braking surfaces and the adjacent jaws of the brake clamping mechanisms.

Figure 13A:
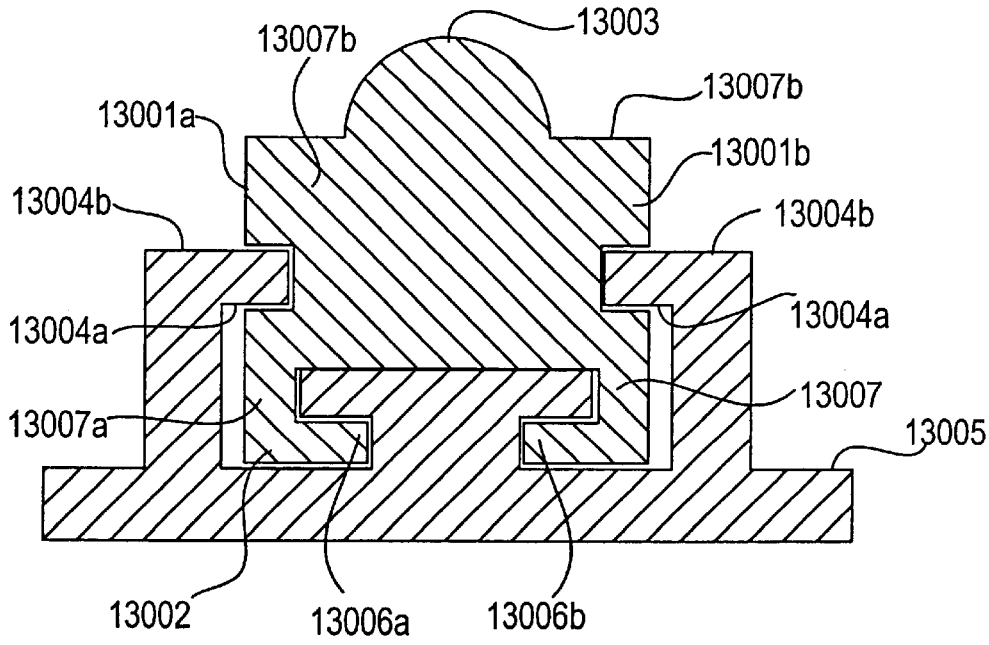
FIGS. 13A and 13B are respectively a cross-sectional view taken along line 13A—13A of FIG. 13B and a plan view of yet another embodiment of a brake system.
Figure 13B:
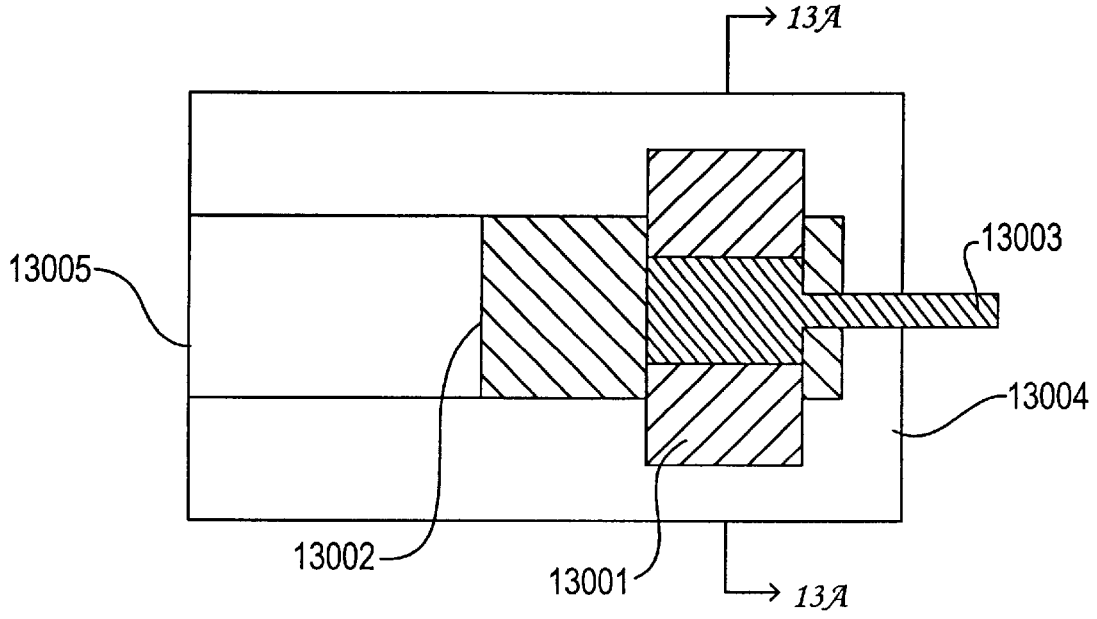

FIG. 13A and B show yet another alternate embodiment for a brake assembly for dissipating recoil of a gas-generating device. Brake clamping mechanisms 13001*a* and *b* are attached to a mounting plate 13002 or to the gas-generating device 13003 which itself is attached to the mounting plate 13002. The mounting plate includes inwardly facing guide plates 13006*a* and *b*. Braking surfaces 13004*a* and *b* are attached to each side of the slide assembly 13005. Each of the brake clamping mechanisms 13001*a* and *b* includes opposing jaws 13007*a* and *b*. The hatched components shown in FIG. 13B, comprised of the gas-generating device 13003, the brake clamping mechanisms 13001, and the mounting plate 13002, move back and forth along the slide assembly 13005.

Figure 14:
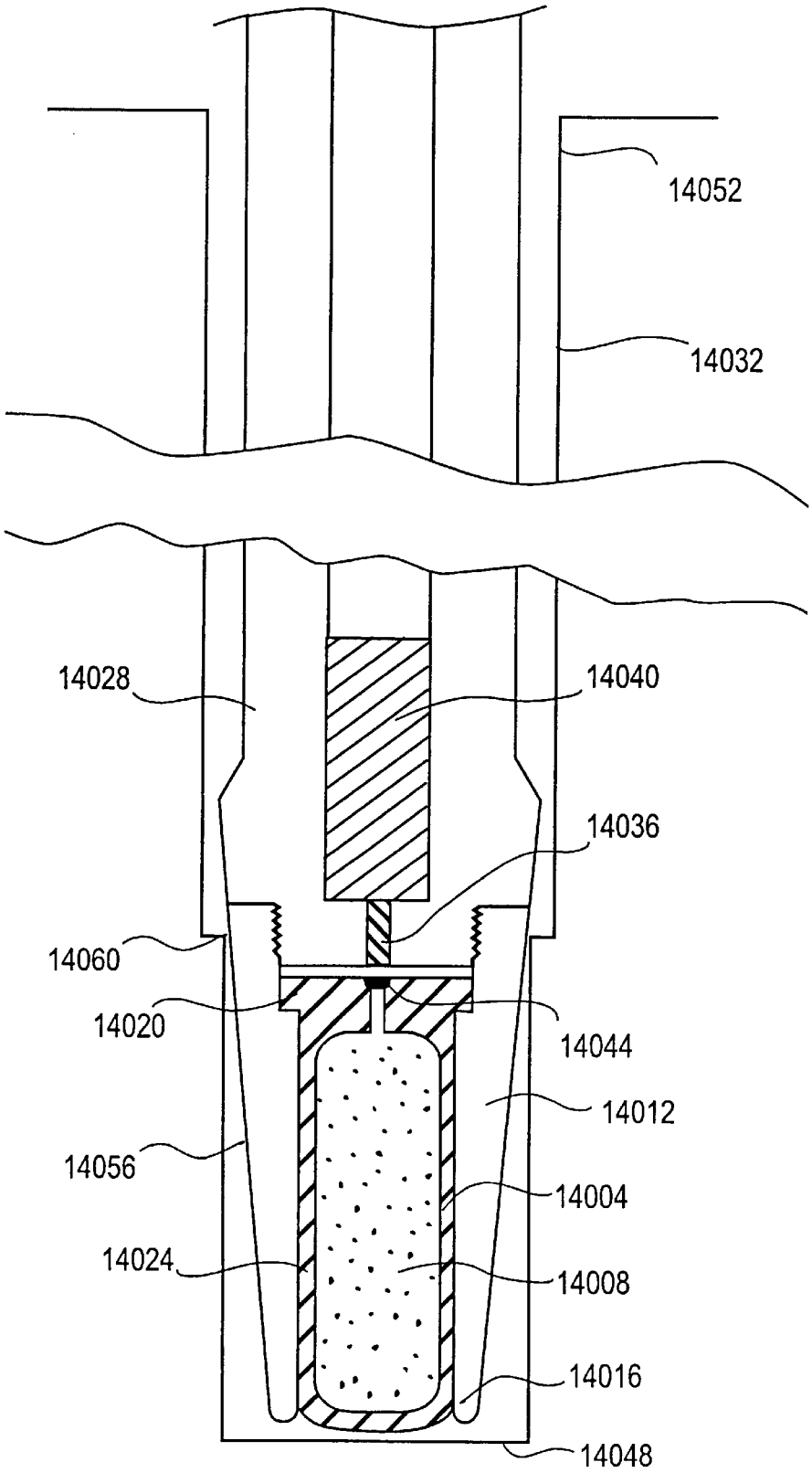
FIG. 14 is a cross sectional side view of a gas generator according to one embodiment.

Another embodiment of the stemming device of the present invention is the gas generator device shown in FIG. 14. It includes a cartridge 14004 containing a propellant charge 14008 which is hand-inserted into a cartridge housing 14012. The cartridge 14004 may be contained completely inside the cartridge housing 14012 or the distal end of the cartridge 14004 may protrude a small distance beyond the muzzle end 14016 of the cartridge housing 14012 (typically about one third less of the overall cartridge length protrudes beyond the muzzle end 14016 of the cartridge housing 14012). The cartridge 14004 may be made with a metallic base 14020 attached to a plastic cartridge body 14024. Alternately, the cartridge 14004 may be formed from only one material such as a plastic, compressed paper, or any other suitable material including combustible material used for consumable ammunition.

When the cartridge 14004 has been inserted, the cartridge housing 14012 is then attached to the end of a long stemming bar 14028 by means of a full thread, an interrupted thread, a bayonet type lug, or another suitable attachment mechanism. The stemming bar 14028, which is usually attached to an undercarrier by means of an extension cylinder, is inserted into a drill hole 14032 such that the cartridge housing 14012 comes to rest at or near the bottom of the hole. It can be appreciated that the stemming bar can be mounted to any suitable undercarriage, that may or may not include a drill for performing the drilling function.

When the device is fully inserted, the propellant 14008 in the cartridge 14004 is initiated and the propellant 14008 is burned to completion generating a controlled high pressure in the bottom portion of the hole. The propellant 14008 may be initiated by a mechanical firing pin 14036, which is itself actuated by a firing pin assembly 14040, striking a percussion primer 14044 inserted in the cartridge base 14020. Alternately, an electric primer may be used and initiated by a current pulse transmitted through an electrical contact with a wire pair running down the stemming bar. The initiator can utilize any other initiation method, including inductive coupling.

Currently, the drill hole 14032 is formed by a reamer/pilot bit combination such that the distal portion 14048 of the drill hole 14032 is a smaller diameter than the proximal portion 14052 of the drill hole 14032. The outside of the cartridge housing 14012 has a slight taper 14056 (smaller diameter towards the distal end) so that the insertion will be stopped when the outside of the cartridge housing 14012 comes to rest on the step or ridge 14060 formed between the distal portion 14048 and the proximal portion 14052 of the drill hole 14032. The taper 14056 is preferably in the range of 0.5 to 3 degrees and most preferably in the range of 0.5 to 1.5 degrees.

Figure 15:
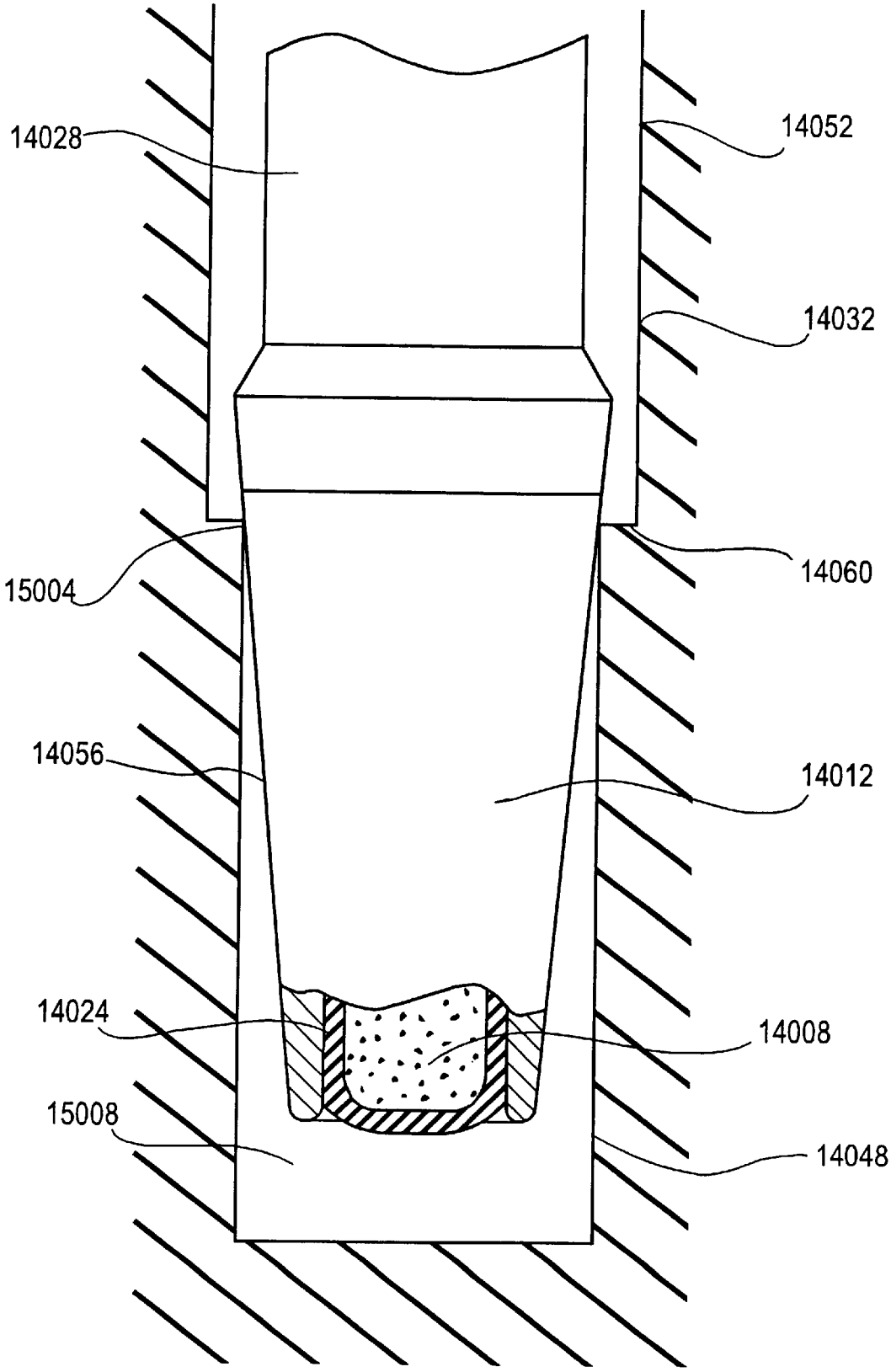
FIG. 15 is a partially cutaway side view of the gas generator of FIG. 14.

As illustrated in FIG. 15, the ridge 14060 of the stepped drill hole 14032 and the taper 14056 of the cartridge housing 14012 form a seal 15004 restricting the flow of pressurized gas in the hole bottom 15008 during the rock-breaking process. The partial cut-away at the distal end of the cartridge housing 14012 illustrates that the cartridge body 14024 and the propellant 14008 are positioned within the cartridge housing 14012.

Figure 16:
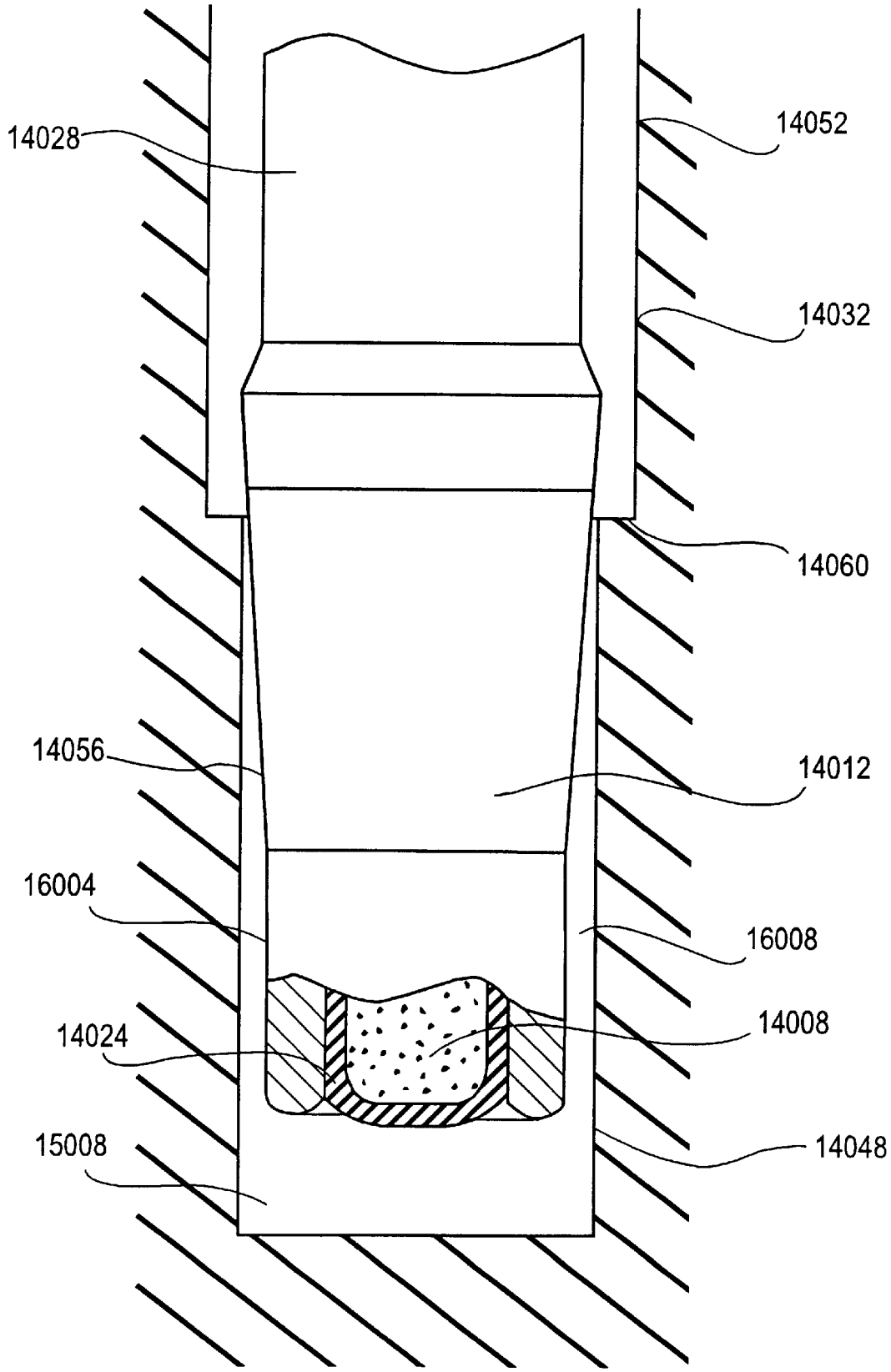
FIG. 16 is a partially cutaway side view of a gas generator according to another embodiment.

Alternate sealing techniques are also possible. For example, as illustrated in FIG. 16, the cartridge housing 14012 may have a straight, constant diameter portion 16004 at its tip that is a reasonably tight fit in the distal portion 14048 of the drill hole 14032. This sealing method provides a gap 16008 that remains roughly constant, even as the device recoils away from the hole bottom 15008 after firing.

The diameter of the distal portion 14048 of the drill hole 14032 is preferably in the range of 30 to 150 mm and most preferably in the range of 50 to 120 mm. The amount of propellant 14008 is preferably in the range of 100 to 750 grams and most preferably in the range of 200 to 450 grams. The length (L) of the pilot hole (distal portion 14048 of the drill hole 14032), expressed in terms of bottom hole diameters (D), is preferably in the L/D range of 0.5 to 6 and most preferably in the L/D range of 1 to 3. The total volume available to the high pressure propellant gas products is such that the average density of the gas is preferably in the range of 100 to 750 $kg/m^3$ and most preferably in the range of 200 to 500 $kg/m^3$.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A small charge blasting device, comprising a stemming member that is received in a hole of a material to be broken including:

a breech having a proximal end for receiving a cartridge and a distal end, the cartridge containing an energetic substance for generating a pressurized working fluid;

a cartridge ejector mechanism for ejecting the cartridge through the distal end of the breech after generation of the pressurized working fluid; and wherein the breech includes a combustion chamber, the combustion chamber releasing the pressurized working fluid into the bottom of the hole.

2. The small charge blasting device of claim 1, wherein the combustion chamber and breech are both located in the hole.

3. The small charge blasting device of claim 1, wherein the ejector mechanism is an elongated rod that inserts the cartridge before use through the proximal end of the breech and ejects the cartridge after use through a muzzle of the stemming member.

4. The small charge blasting device of claim 3, wherein, prior to generation of the pressurized working fluid, the elongated rod pushes the cartridge into the breech.

5. The small charge blasting device of claim 1, wherein a downhole portion of the outer surface of the stemming member has a diameter that is less than the diameter of an adjacent uphole portion of the outer surface of the stemming member to permit the pressurized working fluid to pressurize a sidewall of the hole.

6. The small charge blasting device of claim 1, further comprising:

a slide assembly having a guide track and distal and proximal ends, the stemming member being movably mounted on the slide assembly so as to permit the stemming member to be advanced from the proximal end to the distal end and retracted from the distal end to the proximal end along the guide track.

7. The small charge blasting device of claim 6, wherein the guide track is lined with a braking material having a static coefficient of friction of at least about 0.2 to dampen recoil of the stemming member.

8. The small charge blasting device of claim 6, wherein the guide track is lined with a braking material having a sliding coefficient of friction of at least about 0.2 to dampen recoil of the stemming member.

9. The small charge blasting device of claim 6, further comprising an autoloader for loading the cartridge into the proximal end of the breech, the autoloader being located at the proximal end of the slide assembly.

10. The small charge blasting device of claim 1, further comprising a shock absorber located between the stemming member and a slide assembly to dissipate a recoil energy of the stemming member and reduce a force exerted on the slide assembly by the stemming member.

11. A small charge blasting device, comprising:

a stemming member for sealing a working fluid in a hole in a material to be broken by the working fluid; and a slide assembly having proximal and distal ends, the slide assembly including:

a guide track;

a conveying device for moving the stemming member linearly along the guide track between a stowed stemming member position at the proximal end of the slide assembly and a deployed stemming member position at the distal end of the slide assembly; and a switching device that selectively engages the stemming member with and disengages the stemming member from at least one of the guide track and the conveying device.

12. The small charge blasting device of claim 11, further comprising a drill for forming the hole and wherein the switching device selectively engages the drill with and disengages the drill from at least one of the guide track and the conveying device.

13. The small charge blasting device of claim 12, wherein, when the drill and stemming member are in their respective stowed positions, the drill and stemming member are located on opposite sides of the guide track.

14. The small charge blasting device of claim 11, further comprising an autoloader to load a cartridge into a proximal end of a breech in the stemming member and to eject the cartridge through a distal end of the breech after generation of the working fluid.

15. The small charge blasting device of claim 11, wherein the guide track includes a braking material having a co-efficient of friction of at least about 0.2 to dampen the recoil of the stemming member along the guide track.

16. The small charge blasting device of claim 11, further comprising a clamping device operatively engaged with the guide track and the stemming member for clamping the stemming member in the guide track to dampen the recoil of the stemming member along the guide track in response to the release of the working fluid.

17. The small charge blasting device of claim 11, further comprising a disengaging device for disengaging the stemming member from the conveying device prior to release of the working fluid.

18. The small charge blasting device of claim 11, further comprising a shock absorber located behind the stemming member to dampen the recoil of the stemming member and reduce the recoil force exerted on the slide assembly by the stemming member.

19. The small charge blasting device of claim 11, wherein the conveying device is at least one of a belt drive, a chain drive, a hydraulic extending cylinder, a worm gear drive, a pusher rod drive, a cable drive, and a gas powered extending cylinder.

20. A small charge blasting method, comprising:

(a) switching a stemming member into engagement with at least one of a drive mechanism and a guide track located on a slide assembly;

(b) advancing linearly the stemming member along the guide track to a distal end of the slide assembly to insert the stemming member into a hole in a material to be broken;

(c) when the stemming member is positioned in the hole, releasing and sealing a working fluid in the hole to fracture the material to be broken;

(d) thereafter retracting linearly the stemming member along the guide track to a proximal end of the slide assembly; and (e) switching the stemming member out of engagement with the at least one of the drive mechanism and the guide track.

21. The small charge blasting method of claim 20, further comprising before step (a):

(f) advancing linearly a drill along the guide track to form the hole, and (g) retracting linearly the drill along the guide track to a disengaged drill position wherein the slide assembly remains at least substantially stationary during steps (a), (b), (f) and (g).

22. The small charge blasting method of claim 21, further comprising:

(h) disengaging the drill from at least one of the guide track and the drive mechanism after the retracting step and thereafter engaging in step (a) the stemming member with the at least one of the guide track and the drive mechanism.

23. The small charge blasting method of claim 21, further comprising after the switching step (e):

(h) engaging the drill with at least one of the guide track and the drive mechanism to form a second hole in the material.

24. The small charge blasting method of claim 20, further comprising after step (b):

disengaging the stemming member from the drive mechanism before the releasing step.

25. The small charge blasting method of claim 20, wherein the releasing step includes clamping the stemming member in the guide track to dampen recoil of the stemming member.

26. A small charge blasting method, comprising:

(a) advancing a drill along a guide track to a free surface of a material to be broken;

(b) forming a hole in the material to be broken;

(c) retracting the drill along the guide track and switching the drill to a stowed drill position;

(d) switching a stemming member to a deployed stemming member position and advancing the stemming member along the guide track to insert the stemming member into the hole;

(e) when the stemming member is positioned in the hole, releasing and sealing a working fluid in the hole to fracture the material; and (f) thereafter retracting the stemming member along the guide track and switching the stemming member to a stowed stemming member position.

27. The small charge blasting method of claim 26, further comprising:

(g) switching the drill into engagement with at least one of the guide track and a drive mechanism located adjacent to the guide track;

(h) switching the drill out of engagement with the at least one of the guide track and a drive mechanism to return the drill to the stowed drill position;

(i) switching the stemming member into engagement with the at least one of the guide track and the drive mechanism; and (j) switching the stemming member out of engagement with the at least one of the guide track and the drive mechanism to return the stemming member to the stowed stemming member position.

28. The small charge blasting method of claim 26, further comprising:

(g) disengaging the stemming member from at least one of the guide track and the drive mechanism before the releasing step (e).

29. The small charge blasting method of claim 26, wherein the releasing step (e) includes clamping the stemming member in the guide track to dampen recoil of the stemming member.

30. The small charge blasting method of claim 26, further comprising during the forming step when the stemming member is in the stowed stemming member position:

(g) discharging a used cartridge from the stemming member; and (h) inserting a new cartridge into the stemming member.

31. The small charge blasting method of claim 26, further comprising:

(g) switching the drill into the guide track;

(h) unswitching the drill from the guide track;

(i) switching the stemming member into the guide track; and (j) unswitching the stemming member from the guide track.

32. A small charge blasting method for breaking a hard material, comprising:

positioning a stemming member, breech, and barrel in a hole in the hard material;

inserting a cartridge, the cartridge containing an energetic substance for generating a pressurized working fluid, into the breech through a proximal end of the breech;

generating the pressurized working fluid;

transporting the pressurized working fluid through the barrel and into the hole, thereby causing fracturing of the hard material; and ejecting a spent cartridge housing from the breech through a distal end of the breech.

33. The method of claim 32, further comprising:

engaging the stemming member with at least one of a drive mechanism and a guide track located on a slide assembly;

advancing linearly the stemming member along the guide track to a distal end of the slide assembly to insert the stemming member into a hole in the hard material;

after the generating step, retracting linearly the stemming member along the guide track to a proximal end of the slide assembly; and disengaging the stemming member from the at least one of the drive mechanism and the guide track.

34. The method of claim 33, further comprising:

advancing linearly a drill along the guide track to form the hole, and retracting linearly the drill along the guide track to a disengaged drill position wherein the slide assembly remains substantially stationary during the engaging, advancing, and retracting steps.

35. The method of claim 34, further comprising:

disengaging the drill from at least one of the guide track and the drive mechanism after the retracting step and thereafter engaging the stemming member with the at least one of the guide track and the drive mechanism.

36. The method of claim 34, further comprising:

engaging the drill with at least one of the guide track and the drive mechanism to form a second hole in the material.

37. The method of claim 33, further comprising:

disengaging the stemming member from the drive mechanism before the generating step.

38. The method of claim 33, wherein the generating step includes clamping the stemming member in the guide track to dampen recoil of the stemming member.

39. A small charge blasting device, comprising:

means for sealing a working fluid in a hole in a material to be broken by the working fluid; and a slide assembly having proximal and distal ends, the slide assembly including:

a guide track;

means for conveying the stemming means linearly along the guide track between a stowed stemming means position at the proximal end of the slide assembly and a deployed stemming means position at the distal end of the slide assembly; and switching means that selectively engages the stemming means with and disengages the stemming means from at least one of the guide track and the conveying means.

40. The small charge blasting device of claim 39, further comprising a drill for forming the hole and wherein the switching means selectively engages the drill with and disengages the drill from at least one of the guide track and the conveying means.

41. The small charge blasting device of claim 39, further comprising an autoloader to load a cartridge into a proximal end of a breech in the stemming means and to eject the cartridge through a distal end of the breech after generation of the working fluid.

42. The small charge blasting device of claim 39, wherein the guide track includes a braking material having a co-efficient of friction of at least about 0.2 to dampen the recoil of the stemming means along the guide track.

43. The small charge blasting device of claim 39, further comprising a clamping means operatively engage with the guide track and the stemming means for clamping the stemming means in the guide track to dampen the recoil of the stemming means along the guide track in response to the release of the working fluid.

44. The small charge blasting device of claim 39, further comprising a disengaging means for disengaging the stemming means from the conveying means prior to the release of the working fluid.

45. The small charge blasting device of claim 40, wherein, when the drill and stemming means are in their respective stowed positions, the drill and stemming means are located on opposite sides of the guide track.

46. The small charge blasting device of claim 39, further comprising a shock absorber located behind the stemming member to dampen the recoil of the stemming means and reduce the recoil force exerted on the slide assembly by the stemming means.

47. The small charge blasting device of claim 39, wherein the conveying means is at least one of a belt drive, a chain drive, a hydraulic extending cylinder, a worm gear drive, a pusher rod drive, a cable drive, and a gas powered extending cylinder.

48. A method for fracturing a material, comprising:

(a) inserting a stemming member into a hole in the material, the stemming member including a breech containing a cartridge;

(b) igniting an energetic material in the cartridge while the cartridge is in the breech, thereby releasing a pressurized working fluid out of a muzzle of the stemming member and into the hole;

(c) sealing the pressurized working fluid in the hole, thereby fracturing the material; and (d) thereafter ejecting the cartridge through the muzzle of the stemming member.

49. The method of claim 48, wherein the breech and cartridge are both located in a bottom portion of the hole.

50. The method of claim 48, further comprising:

(e) loading a second cartridge through a proximal end of the breech and wherein a distal end of the breech is located between the proximal end of the breech and the muzzle.

51. The method of claim 48, wherein the inserting step includes:

switching the stemming member into engagement with at least one of a drive mechanism and a guide track located on a slide assembly; and advancing linearly the stemming member along the guide track to a distal end of the slide assembly to insert the stemming member into a hole in a material to be broken and wherein after the sealing step the method further comprises:

thereafter retracting linearly the stemming member along the guide track to a proximal end of the slide assembly; and switching the stemming member out of engagement with the at least one of the drive mechanism and the guide track.

52. The small charge blasting method of claim 51, further comprising before step (a):

(e) advancing linearly a drill along the guide track to form the hole, and (f) retracting linearly the drill along the guide track to a disengaged drill position wherein the slide assembly remains at least substantially stationary during step (a), (f) and (g).

53. The small charge blasting method of claim 52, further comprising:

(g) disengaging the drill from at least one of the guide track and the drive mechanism after the retracting step and thereafter engaging in step (a) the stemming member with the at least one of the guide track and the drive mechanism.

54. The small charge blasting method of claim 53, further comprising after the sealing step:

(h) engaging the drill with at least one of the guide track and the drive mechanism to form a second hole in the material.

55. The small charge blasting method of claim 51, further comprising after step (b):

disengaging the stemming member from the drive mechanism before the igniting step.

56. The small charge blasting method of claim 51, wherein the igniting step includes clamping the stemming member in the guide track to dampen recoil of the stemming member.

* * * * *

UNITED STATES PATENT AND TRADEMARK OFFICE

CERTIFICATE OF CORRECTION

PATENT NO. : 6,347,837 B1 
DATED : February 19, 2002
INVENTOR(S) : Watson et al.

It is certified that error appears in the above-identified patent and that said Letters Patent is hereby corrected as shown below:

Title page,
Item [73], Assignee, please delete "BeckTek" and insert -- RockTek -- therefor.

Signed and Sealed this

Fourth Day of February, 2003

JAMES E. ROGAN
*Director of the United States Patent and Trademark Office*